US007427149B2

(12) United States Patent
Sohn

(10) Patent No.: US 7,427,149 B2
(45) Date of Patent: Sep. 23, 2008

(54) CLIP TYPE LIGHT DETACHABLY COUPLED WITH CAP

(76) Inventor: Dae Up Sohn, 204ho, 222 Dong, Mokdong, Ap. 902-1, Mok-Dong, Yangcheon-Gu, Seoul (KR)

( * ) Notice: Subject to any disclaimer, the term of this patent is extended or adjusted under 35 U.S.C. 154(b) by 0 days.

(21) Appl. No.: 11/620,845

(22) Filed: Jan. 8, 2007

(65) Prior Publication Data

US 2007/0109768 A1 May 17, 2007

Related U.S. Application Data

(63) Continuation-in-part of application No. 11/426,022, filed on Jun. 23, 2006, now Pat. No. 7,163,309, which is a continuation of application No. 10/758,107, filed on Jan. 16, 2004, now Pat. No. 7,118,241.

(30) Foreign Application Priority Data

Jan. 22, 2003 (KR) ..... 20-2003-0002051

(51) Int. Cl.
*F21V 21/00* (2006.01)
*F21V 21/084* (2006.01)

(52) U.S. Cl. ..... 362/374; 362/106; 362/230; 362/396

(58) Field of Classification Search ..... 362/130, 362/105, 106, 190, 191, 230, 290, 396, 364, 362/365, 368, 374, 253
See application file for complete search history.

(56) References Cited

U.S. PATENT DOCUMENTS

| | | | | |
|---|---|---|---|---|
| 1,197,427 | A * | 9/1916 | Arnold | |
| 2,524,881 | A | 10/1950 | Chambers | |
| D188,129 | S | 7/1960 | Wansky | |
| 3,032,647 | A | 5/1962 | Wansky et al. | |
| D228,465 | S | 9/1973 | Louis | |
| 4,215,389 | A * | 7/1980 | Colangelo | |
| 4,298,913 | A * | 11/1981 | Lozar | 362/103 |
| 4,406,040 | A | 9/1983 | Cannone | |
| 4,964,023 | A * | 10/1990 | Nishizawa | |

(Continued)

OTHER PUBLICATIONS

"LEDHedz," Potentials Magazine, Dec. 9, 2002, p. 65, Nielsen Business Media, Inc., New York, NY.*

*Primary Examiner*—John A Ward
(74) *Attorney, Agent, or Firm*—Craig A. Fieschko, Esq.; DeWitt Ross & Stevens S.C.

(57) ABSTRACT

A clip type light is detachably attached to a cap visor so as to ensure the user's field of vision. Two clips are integrally formed with both sides of a front section of a lamp body such that the two clips can be fixedly coupled with a front section of the cap visor regardless of the curved configuration of the visor. The clip type light can be easily attached to or detached from the cap visor without causing damage to the visor, and a switch for operating an electric lamp and an ultrasonic wave generator is provided at a lower portion of the lamp body in such a manner that the user can easily activate the electric lamp and the ultrasonic wave generator while wearing the cap equipped with the clip type light. A solar cell may also be provided to power the lamp and wave generator.

25 Claims, 7 Drawing Sheets

U.S. PATENT DOCUMENTS

| | | | |
|---|---|---|---|
| 5,357,409 | A | 10/1994 | Glatt |
| 5,460,346 | A | 10/1995 | Hirsch |
| 5,467,992 | A | 11/1995 | Harkness |
| 5,485,358 | A | 1/1996 | Chien |
| 5,541,816 | A | 7/1996 | Miserendino |
| D374,731 | S | 10/1996 | Anwyl-Davies |
| D376,469 | S | 12/1996 | Harkness |
| 5,741,060 | A | 4/1998 | Johnson |
| 5,911,494 | A | 6/1999 | Lary |
| 5,991,494 | A | 11/1999 | Otsuka |
| 6,168,286 | B1 | 1/2001 | Duffy |
| 6,206,543 | B1 | 3/2001 | Henry |
| 6,619,813 | B1 | 9/2003 | Schnell |
| 6,644,829 | B1 * | 11/2003 | Tracy |
| 6,659,618 | B2 | 12/2003 | Waters |
| 6,719,417 | B2 | 4/2004 | Hay et al. |
| 6,719,437 | B2 | 4/2004 | Lary et al. |
| 6,733,150 | B1 | 5/2004 | Hanley |
| 6,957,905 | B1 * | 10/2005 | Pritchard |
| 7,000,841 | B2 | 2/2006 | Becker |
| 2006/0157569 | A1 | 7/2006 | Becker |

* cited by examiner

CLIP TYPE LIGHT DETACHABLY COUPLED WITH CAP

CROSS-REFERENCE TO RELATED APPLICATIONS

This application is a continuation-in-part of U.S. patent application Ser. No. 11/426,022 filed Jun. 23, 2006 (now U.S. Pat. No. 7,163,309), which is a continuation of U.S. patent application Ser. No. 10/758,107 filed Jan. 16, 2004 (now U.S. Pat. No. 7,118,241), both of which are incorporated by reference herein.

FIELD OF THE INVENTION

The present invention relates to a clip type light emitter, and in particular to a clip type light emitter capable of enhancing a visual field at night by detachably engaging a clip type light emitter to a hat or leisure cap generally used for sports, travel, etc.

BACKGROUND OF THE INVENTION

In general, in order to protect the face of a user from sunlight while ensuring the user's field of vision during leisure activity or sports activity, such as mountaineering, fishing, exercising, traveling, hiking, or jogging, the user wears a cap having a visor protruding from the front section of the cap. The user may also wear the cap when working, including at night.

Although the cap does not cause special problems when the user is engaged in daytime activities, such a cap does not ensure the user's field of vision at night, so the user must carry a light source (e.g. a flashlight).

In addition, since the user must move while gripping the light source when the user is engaged in night activities, the activity of the user may become impeded. Further, since the user must move along the path illuminated by the light, the user may be careless of peripheral environment, resulting in an accident.

Moreover, in the case of night work requiring illumination, the worker must illuminate the working place by gripping the light source in one hand. Accordingly, the worker has to perform the work singlehandedly, causing inconvenience. In addition, when it is necessary to perform the work using both hands, another worker is necessary to hold the light source.

To solve the problems described above, the applicant of the present invention has obtained U.S. Pat. Nos. 7,118,241 and 7,163,309, which disclose a clip type light which may be detachably coupled with a cap visor.

As illustrated in FIG. 1, this clip type light includes a plurality of electric lamps 24 (e.g., LEDs, incandescent bulbs, or the like) installed at the front side of a case 22. A switch 26 operating the electric lamps 24 is installed at one side of the case 22. A battery is accommodated in the case 22, and a clip 28 having elasticity is provided on the case 22, in which one side/end of the clip 28 is integrally formed with the top of the case 22.

In the conventional clip type light having the above structure, if the user pushes the clip type light from the front side to the rear side of the cap visor, the other end of the clip having one end fixed to the case moves upward, so that the cap visor is fixedly inserted between the case of the lamp and the clip. In this state, if the user operates the switch installed at one side of the case, the electric lamps turn on, thereby illuminating the area in front of the cap visor.

SUMMARY OF THE INVENTION

An object of the present invention is to provide a clip type light, which is easily attached or detached from a cap visor while keeping an external appearance of the cap visor regardless of the various curved configurations of the cap visor, without causing damage to an outer skin of the cap visor, while preventing the lamp from moving or separating from the cap visor even if the user is involved in intensive activities.

The clip type light may include a switch, which is provided at a lower portion of a body of the clip type light so as to operate an electric lamp and an ultrasonic wave generator (e.g., ultrasonic insect repellent) in such a manner that the user can easily operate the electric lamp and the ultrasonic wave generator while wearing the cap equipped with the clip type light.

The ultrasonic generator may be provided at a lower portion of the clip type light in order to generate ultrasonic waves to prevent insects from gathering in the vicinity of the electric lamp of the clip type light.

The clip type light may also or alternatively include a solar cell plate installed on a body of the clip type light in order to allow a user to use the clip type light at night by charging a battery accommodated in the body using solar energy.

The clip type light may also or alternatively include a clip section having a head part protruding forward and upward from a body of the clip type light in such a manner that the head part may serve as a billboard or a print board for exhibiting product names or advertisements.

The clip type light may take the form of a body having a smoothly curved surface and accommodating a battery therein; a plurality of electric lamps installed at a front portion of the body; and first and second clips having first end portions fixed to the front portion of the body and second end portions elastically moved up and down, in which the first and second clips include first and second protrusions having arc-shaped sections and being integrally formed with the front portion of the body while protruding beyond the front portion of the body, and first and second clip fixing sections extending downward from the first and second protrusions that define first and second locking holes therein.

Alternatively or additionally, the clip type light may take the form of a body having a smoothly curved surface and accommodating a battery therein; a plurality of electric lamps installed at a front portion of the body; first and second clips having first end portions fixed to the front portion of the body and second end portions elastically moved up and down, in which the first and second clips include first and second protrusions having arc-shaped sections and being integrally formed with the front portion of the body while protruding beyond the front portion of the body, and first and second clip fixing sections extending downward from the first and second protrusions that define first and second locking holes therein; and a solar cell plate installed on the body.

Coupling holes are preferably formed at both sides of the front portion of the body, and the solar cell plate includes a body section positioned between the first and second clips; an extension member extending along a bottom surface of the body section from a front portion of the body section and having an arc-shaped section; and power-supplying protrusions provided at both sides of a rear portion of the extension member in such a manner that the power-supplying protrusions are detachably inserted into the coupling holes to apply power accumulated in a solar cell to the battery accommodated in the body.

Alternatively or additionally, the clip type light may take the form of a body having a smoothly curved surface and accommodating a battery therein; a plurality of electric lamps installed at a front portion of the body; and a clip section installed on the body, in which the clip section includes a head having an arc-shaped section that protrudes upward in a front direction from the front portion of the body while forming a coupling hole therein, and first and second clip fixing sections extending along a bottom surface of the body from both sides of the head, and in which center portions of the first and second clip fixing sections closely make contact with the body and end portions of the first and second clip fixing sections are bent upward.

This clip type light may further include a solar cell plate installed on the body. Coupling holes are formed at both sides of the front portion of the body, and the solar cell plate includes a body section positioned between the first and second clips; an extension member extending along a bottom surface of the body section from a front portion of the body section and having an arc-shaped section; and power-supplying protrusions provided at both sides of a rear portion of the extension member in such a manner that the power-supplying protrusions are detachably inserted into the coupling holes to apply power accumulated in a solar cell to the battery accommodated in the body.

The foregoing clip type lights may further include an ultrasonic wave generator accommodated in the body; and a switch for operating the electric lamps and the ultrasonic wave generator. A plurality of ultrasonic wave ports may be formed at upper and lower portions of the body so as to emit ultrasonic waves, which are generated from the ultrasonic wave generator, to an exterior. The switch preferably protrudes from a bottom surface of the body in a hemispherical shape.

The foregoing clip type lights may further include a connection jack provided at one side of the body for connecting to an external power source to charge the battery accommodated in the body.

DETAILED DESCRIPTION OF PREFERRED VERSIONS OF THE INVENTION

Hereinafter, clip type lights according to various embodiments of the present invention will be described with reference to the accompanying drawings.

Figure 1:
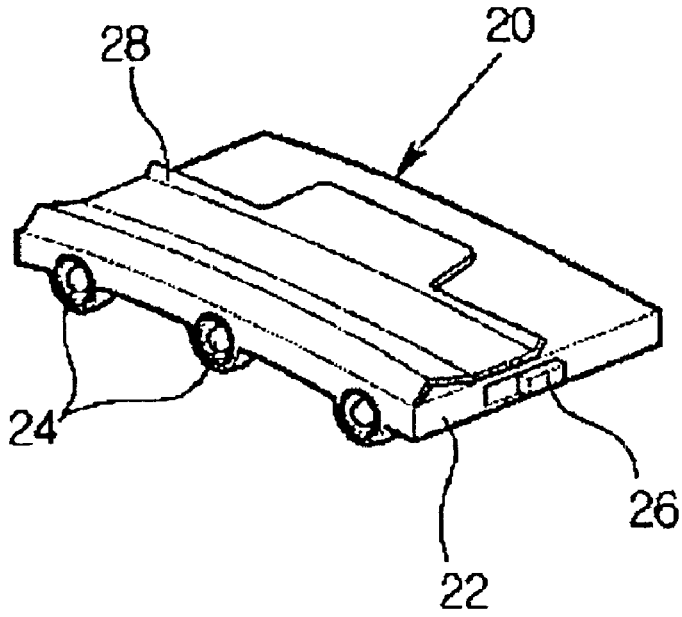
FIG. 1 is a perspective view showing a prior related clip type light.
Figure 2:
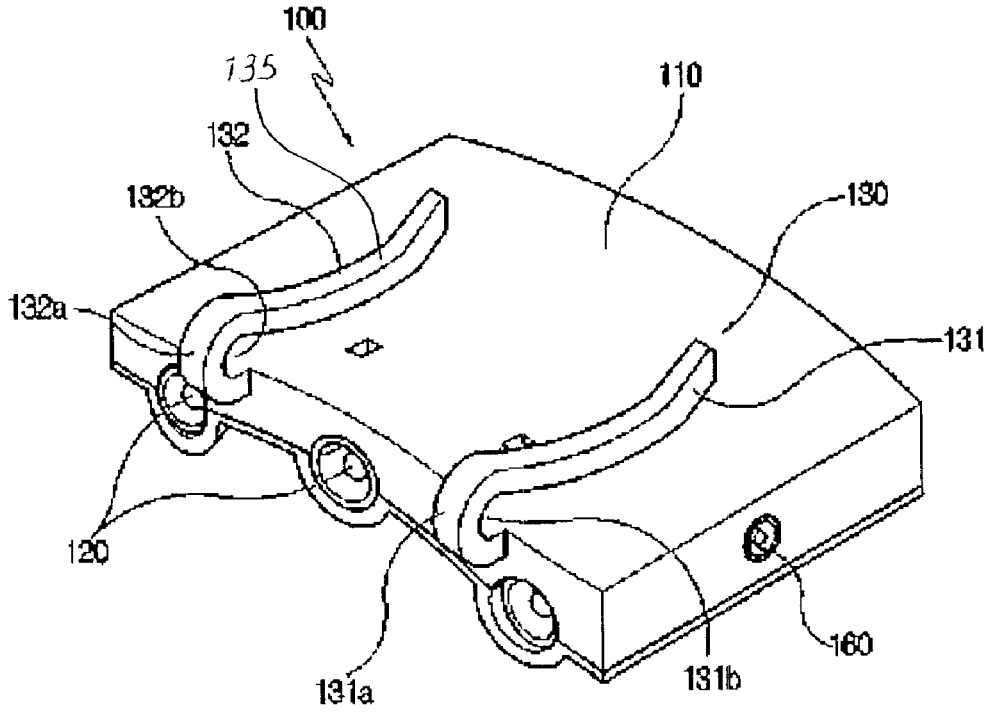
FIG. 2 is a perspective view showing a clip type light according to the first embodiment of the present invention.
Figure 3:
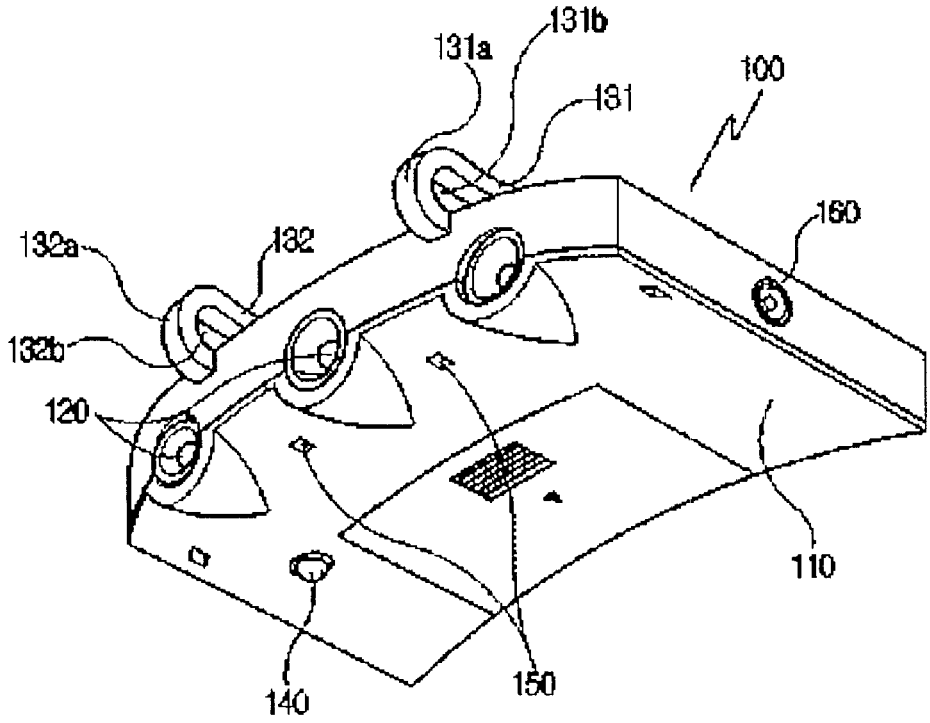
FIG. 3 is a perspective view showing a bottom side of a clip type light.
Figure 4:
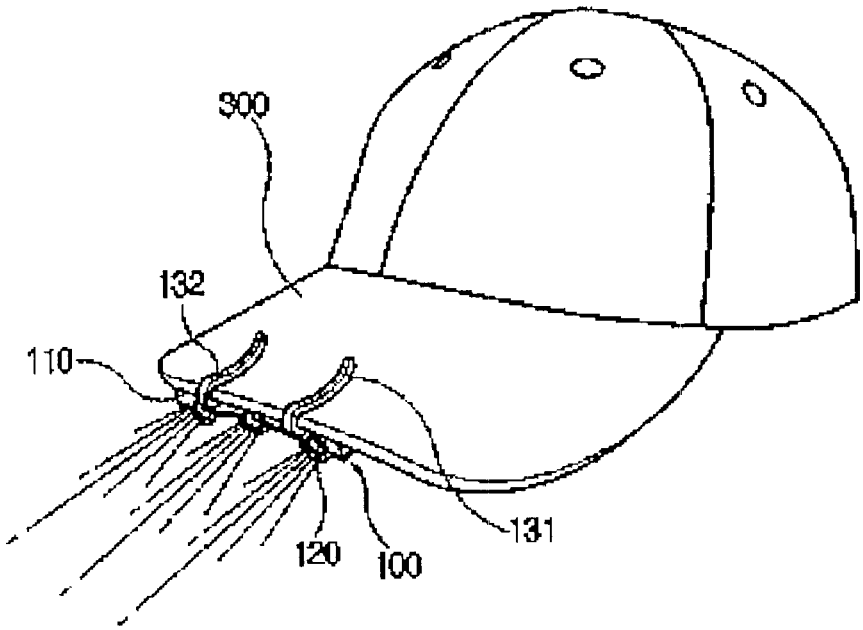
FIG. 4 is a perspective view showing a usage state of a clip type light coupled with a cap visor according to the first embodiment of the present invention.
Figure 5:
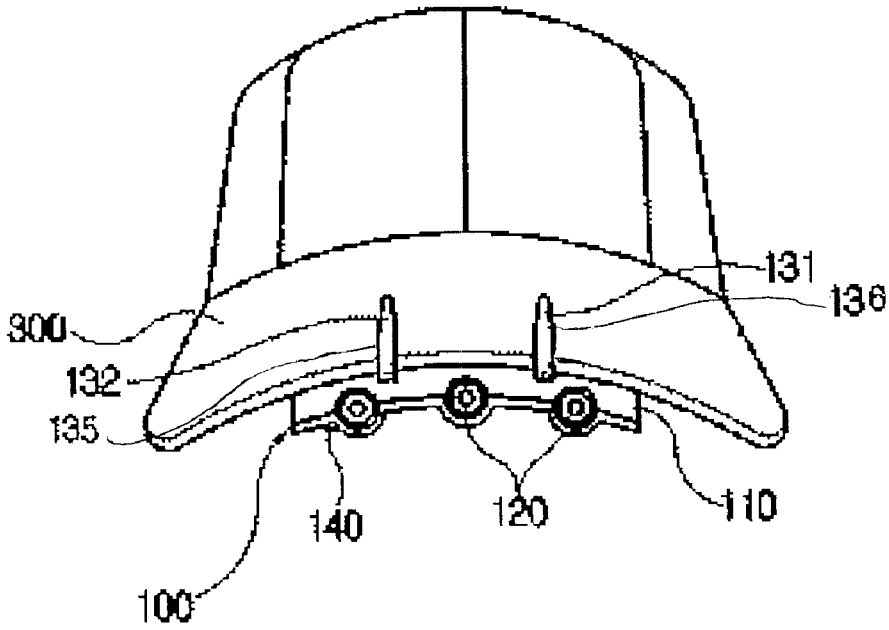
FIG. 5 is a front view showing a clip type light coupled with a cap visor according to the first embodiment of the present invention.

As shown in FIGS. 2, 3 and 4, the clip type light according to the first embodiment of the present invention includes a body 110, in which a battery is accommodated. An upper portion of the body 110 closely adheres to a lower portion of a cap visor 300 having a smoothly curved surface. A plurality of electric lamps 120 are provided at the front portion of the body 110. First end portions of first and second clips 131 and 132 are fixed to the front portion of the body 110 and second end portions of the first and second clips 131 and 132 are elastically movable away from and towards the upper portion of the body 110.

The first and second clips 131 and 132 include first and second protrusions 131*a* and 132*a*, which have arc-shaped section and are integrally formed with the front portion of the body 110 while slightly protruding beyond the front portion of the body 110, and first and second clip fixing sections 135 and 136, which extend downward from the first and second protrusions 131*a* and 132*a*.

In addition, the first and second protrusions 131*a* and 132*a* define first and second locking holes 131*b* and 131*b* such that a rim of the cap visor 300 can be securely rested in the first and second locking holes 131*b* and 131*b*.

In order to allow the clip type light to be easily coupled with the cap visor 300, center portions of the first and second clip fixing sections 135 and 136 make contact with the body 110 and the end portions of the first and second clip fixing sections 135 and 136 are slightly bent upward.

As mentioned above, the clip type light according to the present invention includes a split type clip divided into two parts, so the clip can be attached to the cap without deforming the outer appearance of the cap.

A switch 140 is installed at a lower side of the body 110 in order to operate the electric lamps 120 and an ultrasonic wave generator (not shown) accommodated in the body 110. In addition, a plurality of ultrasonic wave ports 150 are formed at upper and lower portions of the body 110 so as to allow ultrasonic waves generated from the ultrasonic wave generator to be easily emitted out of the body 110.

If the user pushes the switch 140 one time, the electric lamps 120 are turned on, thereby irradiating light. In addition, the ultrasonic wave generator accommodated in the body 110 is also operated, generating ultrasonic waves. In this state, if the user pushes the switch 140 again, the electric lamps 120 may strobe or flicker in a predetermined time interval, but the ultrasonic wave generator continuously generates the ultrasonic waves. In this state, if the user pushes the switch 140 one more time, the electric lamps 120 are turned off and the operation of the ultrasonic wave generator stops.

As shown in FIG. 3, the switch 140 protrudes from the bottom surface of the body 110, preferably, in the form of a hemispherical structure, so as to allow the user to easily operate the switch 140.

Meanwhile, a connection jack 160 can be provided at one side of the body 110. The connection jack 160 may be connected to an external power source to charge the battery accommodated in the body 110.

As shown in FIGS. 4 to 7, in such a clip type light 100 having the above structure, the cap visor 300 is positioned between the body 110 of the light 100 and the first and second clips 131 and 132. At this time, since the end portions of the first and second clip fixing sections 135 and 136 of the first and second clips 131 and 132 are bent upward, the light 100 can be easily coupled with the cap visor 300 if the user pushes the light 100 from the front side to the rear side of the cap visor 300. In addition, since both sides of the body 110 are curved downward while forming a curved surface, the body 110 can be closely coupled with the cap visor 300 having the curved configuration.

At this time, since the end portions of the first and second clip fixing sections 135 and 136 are bent upward relative to the upper surface of the cap visor 300, and the body 110 fully makes contact with the bottom surface of the cap visor 300 without requiring excessive force; the outer skin of the cap visor 300 may not be damaged by the first and second clips 131 and 132.

In the clip type light 100 attached to the cap visor 300, the rim of the cap visor 300 is fixedly inserted into the locking holes 131*b* and 132*b* formed at center portions of the first and second protrusions 131*a*and 132*a*of the first and second clips 131 and 132, and the first and second clips 131 and 132 are fixedly supported on the upper surface of the cap visor 300, so that the light 100 can be secured at the fixed position in the cap visor 300 without being separated from the cap visor 300, even if the user is involved in intensive activities, such as hiking or jogging.

Figure 6:
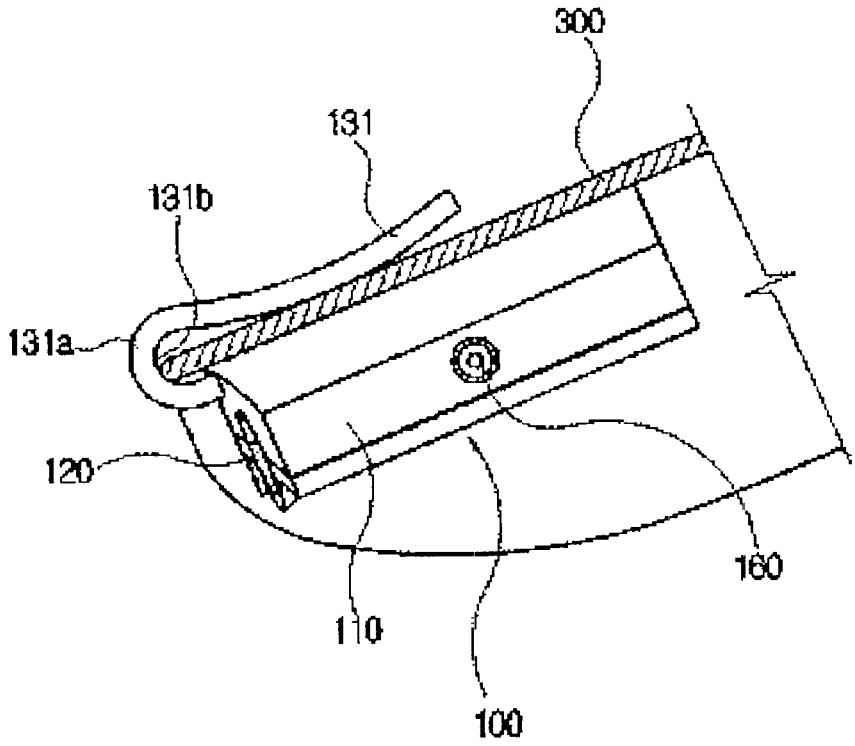
FIG. 6 is a side sectional view showing a clip type light coupled with a cap visor according to the first embodiment of the present invention.
Figure 7:
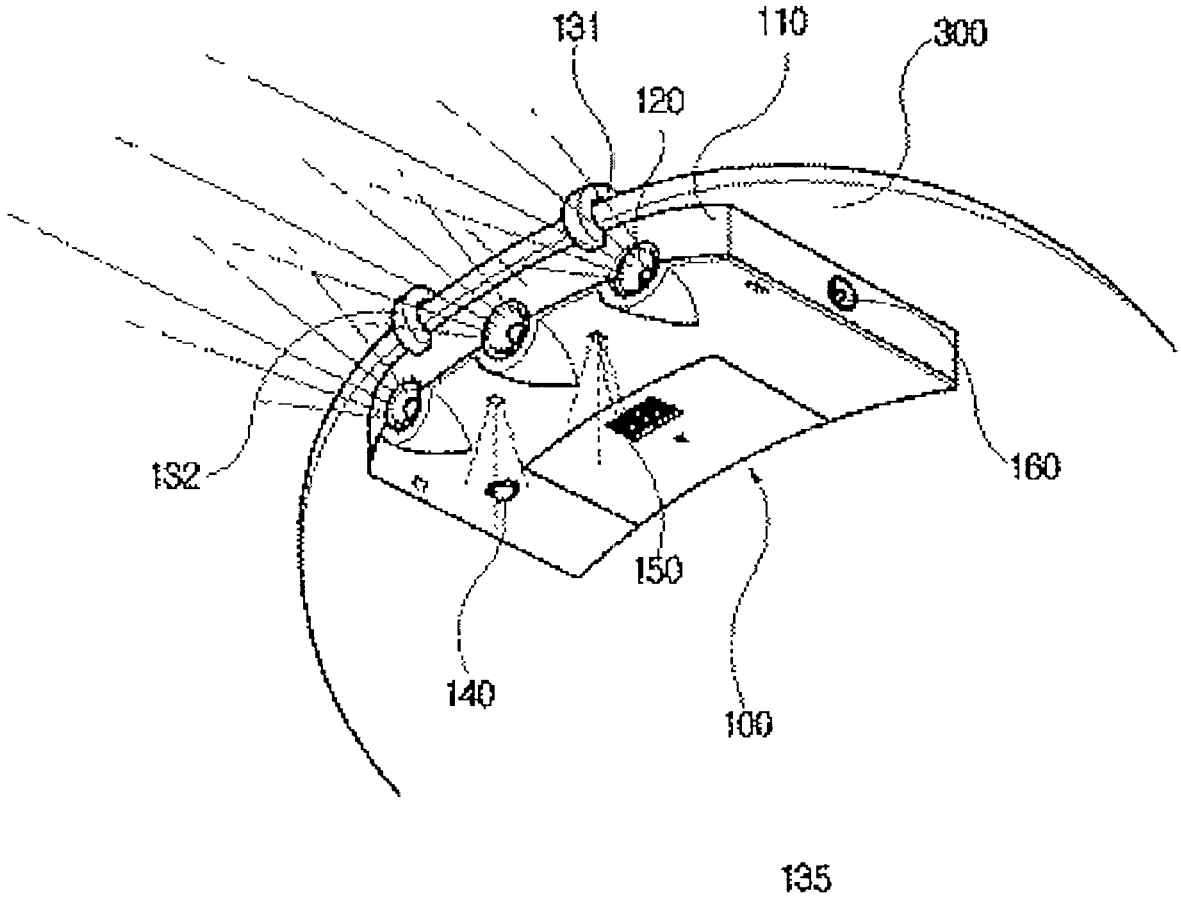
FIG. 7 is a perspective view showing a bottom side of a clip type light coupled with a cap visor according to the first embodiment of the present invention.

In addition, as shown in FIGS. 6 and 7, in a state in which the clip type light 100 is fixedly attached to the cap visor 300, the front end portion of the cap visor 300 is positioned in the locking holes 131*b* and 132*b* of the first and second protrusions 131*a*and 132*a*, so the front portion of the cap visor 300 may protrude beyond the body 110 of the clip type light 100. Accordingly, raindrops falling on the upper surface of the cap visor 300 may be prevented from being introduced into the electric lamps 120 provided at the front portion of the body 110 of the light 100.

When it is necessary to operate the electric lamps 120 of the light 100 fixed to the cap visor 300 at night, the user simply pushes the switch 140 having the hemispherical shape, which protrudes from the bottom surface of the body 110 of the light 100, thereby operating the electric lamps 120.

In addition to the illumination function of the electric lamps 120, the electric lamps 120 may strobe or flicker in a predetermined time interval, if the user pushes the switch 140 one more time. This strobing function of the electric lamps 120 is very advantageous when the user is in emergency or when it is necessary to notify others of the position of the user.

Meanwhile, although it is not illustrated in figures, according to another embodiment of the present invention, a pair of switches 140 can be installed at both sides of the bottom surface of the body 110. In this case, one switch serves to operate the electric lamps 120 provided at the front portion of the body 110, and the other switch serves to operate the ultrasonic wave generator accommodated in the body 110 of the clip type light 100.

In addition, it is also possible to operate the ultrasonic wave generator accommodated in the body 110 of the clip type light 100 simultaneously with the electric lamps 120 by manipulating the switch 140 of the clip type light 100. In this case, ultrasonic waves are emitted through the ultrasonic wave ports 150 formed at the lower portion of the light body 110, thereby preventing insects, such as mosquitoes, from gathering in the vicinity of the electric lamps 120.

The ultrasonic wave ports 150 may include perforation holes, which are formed at the lower portion of the body 110 when the body 110 is fabricated through injection molding. In addition, the ultrasonic wave ports 150 can be formed at the lower portion of the body 110 after the body 110 has been fabricated.

Meanwhile, when the clip type light 100 of the present invention is not used, the user connects the connection jack 160 provided at one side of the body 110 to an external power source, such as a lighter socket installed in a vehicle, thereby charging the battery accommodated in the body 110 of the light 100. Thus, the user can use the clip type light 100 for a long period of time.

Hereinafter, the clip type light according to the second embodiment of the present invention will be described with reference to FIGS. 8 to 10. The same reference numerals will be used to refer to the same elements throughout the specification.

Figure 8:
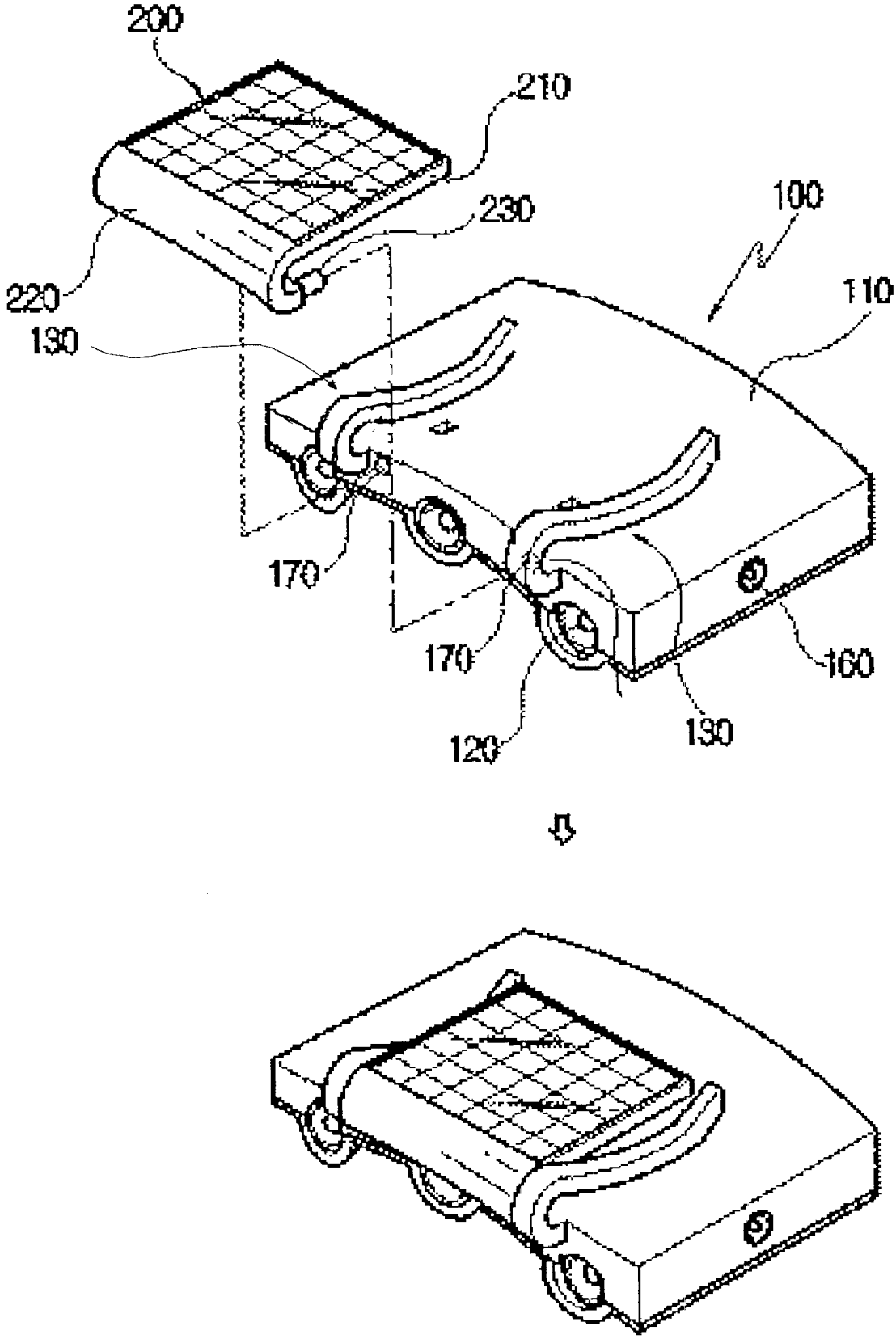
FIG. 8 is an exploded perspective view showing a clip type light according to the second embodiment of the present invention.
Figure 9:
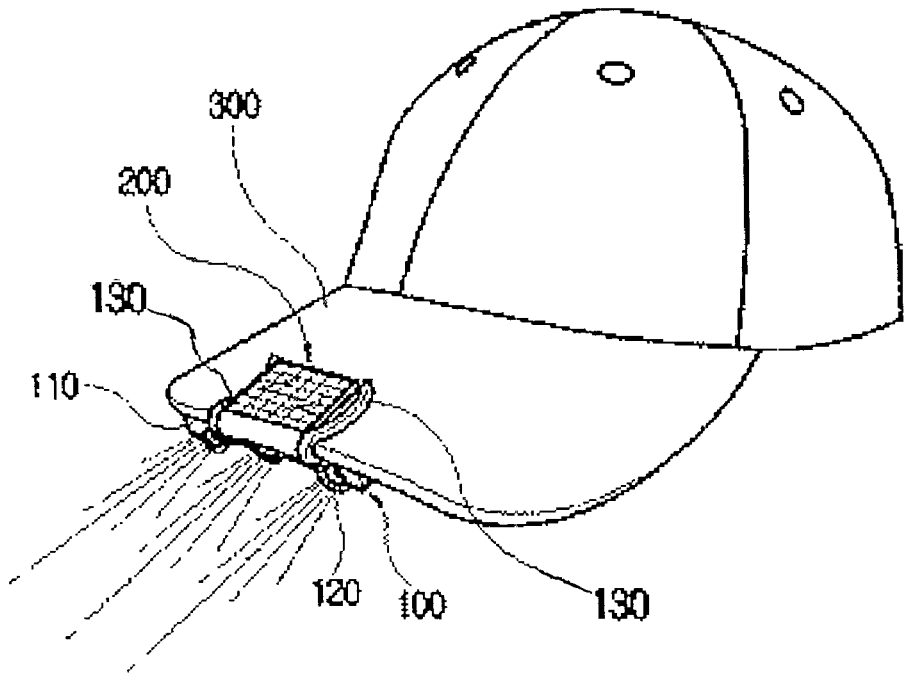
FIG. 9 is a perspective view showing a clip type light shown in FIG. 8 coupled with a cap visor.
Figure 10:
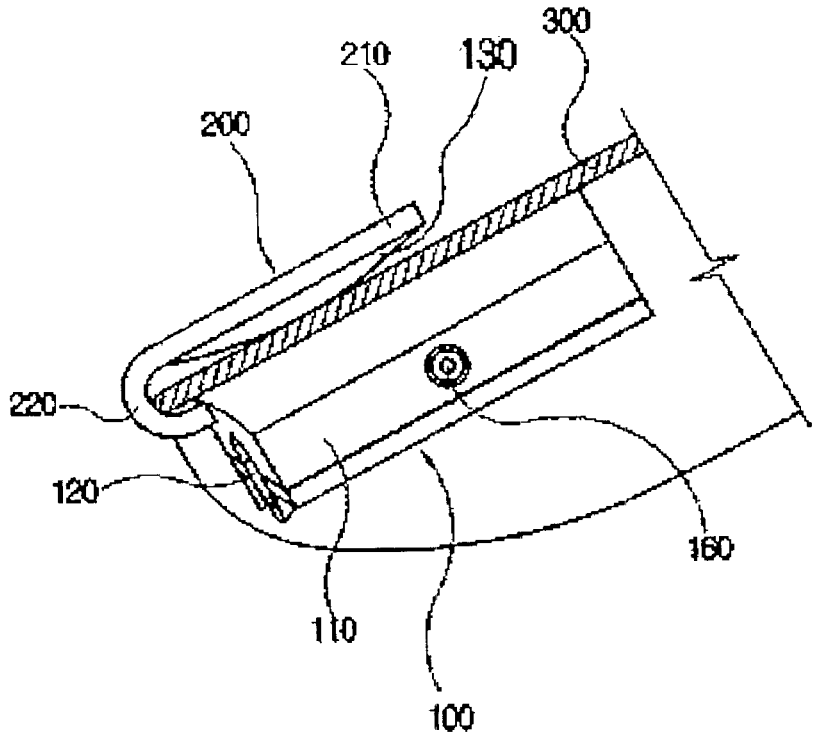
FIG. 10 is a side sectional view showing a clip type light coupled with a cap visor according to the second embodiment of the present invention.

FIG. 8 is an exploded perspective view showing the clip type light according to the second embodiment of the present invention, FIG. 9 is a perspective view showing the clip type light shown in FIG. 8 coupled with a cap visor, and FIG. 10 is a side sectional view showing the clip type light coupled with the cap visor according to the second embodiment of the present invention.

The clip type light according to the second embodiment of the present invention is substantially identical to clip type light according to the first embodiment of the present invention, except that a pair of coupling holes 170 are formed at the front portion of the body 110 and a solar cell plate 200 is coupled with the body 110 through the coupling holes 170.

As shown in FIGS. 8 to 10, the solar cell plate 200 coupled with the clip type light 100 according to the second embodiment of the present invention includes a body 210, which is installed between a pair of clips 130. An extension member 220 is integrally formed with the front portion of the body 210. The extension member 220 has an arc-shaped section and power-supplying protrusions 230 are provided at both sides of the rear portion of the extension member 220 in such a manner that the power-supplying protrusions 230 can be inserted into the coupling holes 170 formed at both sides of the front portion of the body 110 to apply power to the battery accommodated in the body 210.

Preferably, as shown in FIG. 10, the solar cell plate 200 is positioned on the upper surface of the cap visor 300.

In the daytime, the clip type light according to the second embodiment of the present invention stores energy by absorbing solar heat through the solar cell plate 200, thereby charging the battery accommodated in the body 110 of the light 100. Thus, the user can use the light at night, without using an external power source.

In addition, although the present invention has been described in that the solar cell plate 200 is detachably coupled to the body 110 of the light 100, the solar cell plate 200 can be integrally formed with the body 110 of the light 100 or can be installed on the body 110 using a separate fixing unit.

Preferably, the solar cell plate has a large area to receive as much light from the sun as possible. To this end, the solar cell plate may have a foldable structure. In this case, the user may unfold the solar cell plate in daytime to receive solar energy and fold the foldable solar cell plate at night to easily store the foldable solar cell plate.

Figure 11:
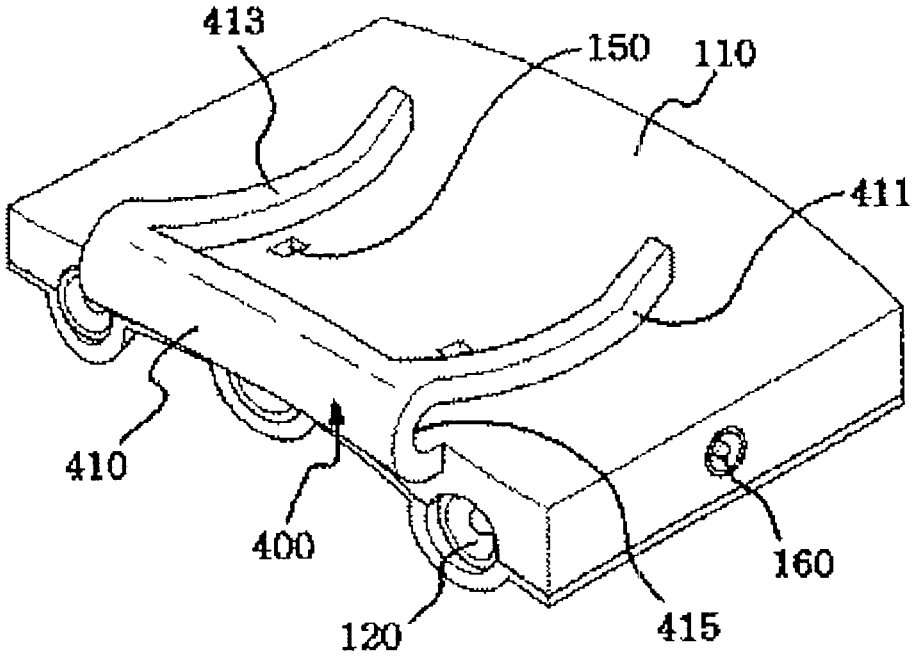
FIG. 11 is a perspective view showing a clip type light according to the third embodiment of the present invention.
Figure 12:
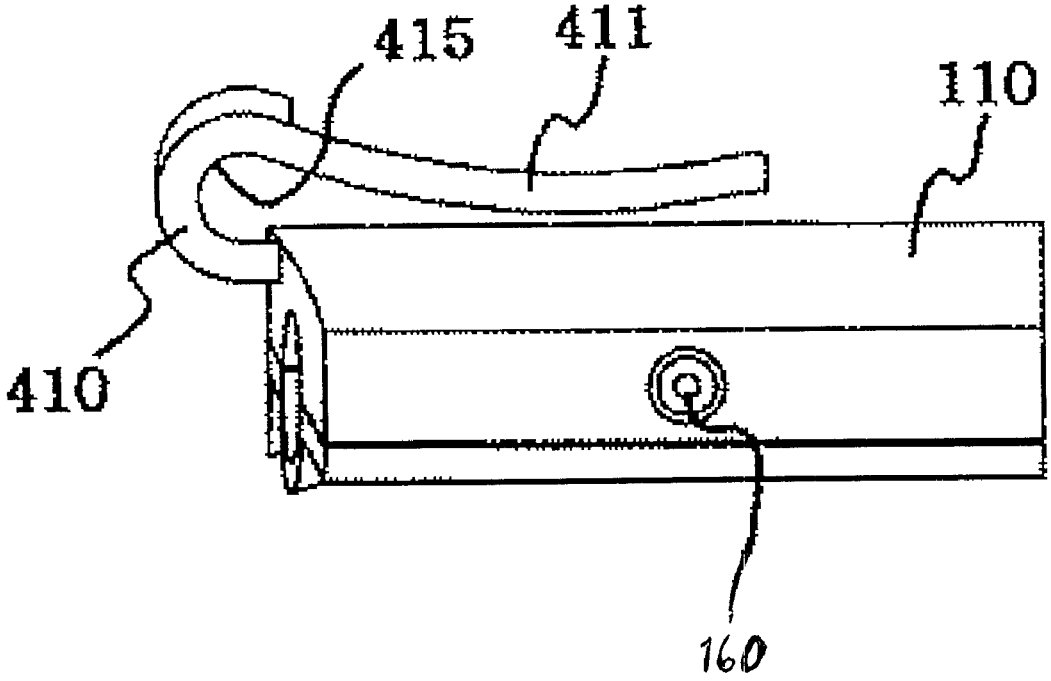
FIG. 12 is a right-side view of FIG. 11.

FIG. 11 is a perspective view showing a clip type light according to the third embodiment of the present invention, and FIG. 12 is a right-side view of FIG. 11.

The clip type light according to the third embodiment of the present invention is substantially identical to the clip type light according to the first embodiment of the present invention, except for the shape of the clip.

As shown in FIGS. 11 and 12, the clip type light according to the third embodiment of the present invention includes a clip section 400 coupled to the body 110 of the clip type light. The clip section 400 is provided with a head 410 having an arc-shaped section that protrudes upward in the front direction from the front portion of the body 110. First and second clip fixing sections 411 and 413 are provided at both sides of the head 410. The first and second clip fixing sections 411 and 413 extend along the upper surface of the body 110.

A locking hole 415 is defined by means of the head 410, and the rim of the cap visor 300 is fixedly inserted into the locking hole 415.

In addition, in order to allow the clip type light to be easily coupled with the cap visor 300, the center portions of the first and second clip fixing sections 411 and 413 closely make contact with the body 110 and end portions of the first and second clip fixing sections 411 and 413 which are bent upward from the upper surface of the cap visor 300.

Furthermore, since the front portion of the head 410 has a large surface area, the head 410 may serve as a billboard or a print board for exhibiting product names or advertisements.

As described above, according to the clip type light of the present invention, the body of the light is bent downward while forming the curved surface. In addition, first end portions of first and second clips are integrally formed with the body and second end portions of the first and second clips are elastically moved up and down, so that the cap visor is fixedly coupled with the first and second clips when the clip type light is attached to the cap visor. Therefore, the clip type light is easily attached to or detached from the cap visor while keeping the external appearance of the cap visor regardless of the various curved configurations of the cap visor; without causing damage to the outer skin of the cap visor; while preventing the light from moving or separating from the cap visor even if the user is in intensive activities.

In addition, the clip type light according to the present invention includes a switch provided at the lower portion of the light body in such a manner that the user can easily operate the electric lamp and the ultrasonic wave generator using the switch while wearing the cap equipped with the clip type light.

Furthermore, according to the present invention, the clip type light emits ultrasonic waves through the ultrasonic wave ports formed at the lower portion of the light body, thereby preventing winged or harmful insects, such as moths or mosquitoes, from gathering in the vicinity of the electric lamps of the clip type light.

Further, since the solar cell plate is provided on the body, the solar cell can be automatically charged in the outdoors during the daytime. In addition, the head part of the body may serve as a billboard or a print board for exhibiting product names or advertisements.

In addition, the clips provided at both upper sides of the light body are integrally formed with the light body, so that the clip type light has a secure and simple construction.

The invention is not intended to be limited to the preferred versions of the invention described above, but rather is intended to be limited only by the claims set out below. Thus, the invention encompasses all different versions that fall literally or equivalently within the scope of these claims.

What is claimed is:

1. A clip-on light comprising:

a. a body including:

(1) a front body side and an opposing rear body side, with the body having a body depth defined between the opposing front and rear body sides, (2) opposing top and bottom body sides extending between the front and rear body sides, with the body having a body thickness defined between the opposing top and bottom body sides, (3) opposing left and right body sides extending between the front and rear body sides and also between the top and bottom body sides, with the body having a body width defined between the opposing left and right body sides, b. lamps located about the front body side;

c. at least two clips provided on the body, the clips extending forwardly from the front body side to curve first upwardly and then downwardly and rearwardly over the top body side, wherein a locking hole is defined within the curve of each clip forwardly from the front body side, and wherein the space between each clip and the top body side decreases as each clip extends rearwardly from the locking hole.

2. The clip-on light of claim 1 wherein the space between each clip and the top body side, after decreasing as each clip extends rearwardly from the locking hole, then increases as each clip extends further rearwardly from the locking hole.

3. The clip-on light of claim 1 wherein the body is substantially thin, with:

a. a body thickness substantially smaller than the body width and body depth, and b. top and bottom body sides substantially larger than the front and rear body sides and the top and bottom body sides.

4. A clip-on light comprising:

a. a body including:

(1) a front body side and an opposing rear body side, with the body having a body depth defined between the opposing front and rear body sides, (2) opposing top and bottom body sides extending between the front and rear body sides, with the body having a body thickness defined between the opposing top and bottom body sides, (3) opposing left and right body sides extending between the front and rear body sides and also between the top and bottom body sides, with the body having a body width defined between the opposing left and right body sides, (4) an ultrasound generator;

b. lamps located about the front body side;

c. at least two clips provided on the body, the clips extending forwardly from the front body side to curve first upwardly and then downwardly and rearwardly over the top body side, wherein a locking hole is defined within the curve of each clip forwardly from the front body side.

5. The clip-on light of claim 4 a. wherein the body further includes a solar cell situated thereon adjacent the top body side, and b. the ultrasound generator emits ultrasound from at least one of the body sides other than the top body side.

6. The clip-on light of claim 4 wherein the ultrasound generator emits ultrasound from at least one of:

a. the bottom body side, b. the front body side, c. the left body side, and d. the right body side.

7. A clip-on light comprising:

a. a body including:

(1) a front body side and an opposing rear body side, with the body having a body depth defined between the opposing front and rear body sides, (2) opposing top and bottom body sides extending between the front and rear body sides, with the body having a body thickness defined between the opposing top and bottom body sides, (3) opposing left and right body sides extending between the front and rear body sides and also between the top and bottom body sides, with the body having a body width defined between the opposing left and right body sides, (4) an electrical port which receives a powering plug, b. lamps located about the front body side;

c. at least two clips provided on the body, the clips extending forwardly from the front body side to curve first upwardly and then downwardly and rearwardly over the top body side, wherein a locking hole is defined within the curve of each clip forwardly from the front body side.

8. The clip-on light of claim 7 in combination with a solar cell wherein:

a. the solar cell includes a powering plug extending therefrom;

b. the solar cell and powering plug are configured to retain the solar cell in a fixed position upon the clip-on light when the powering plug is received within the electrical port.

9. The clip-on light of claim 8 wherein:

a. the body includes two or more electrical ports; and b. the solar cell includes two or more powering plugs.

10. The clip-on light of claim 9 wherein the electrical ports are situated on the body between the clips.

11. A clip-on light comprising:

a. a body including:

(1) a front body side and an opposing rear body side, with the body having a body depth defined between the opposing front and rear body sides, (2) opposing top and bottom body sides extending between the front and rear body sides, with the body having a body thickness defined between the opposing top and bottom body sides, (3) opposing left and right body sides extending between the front and rear body sides and also between the top and bottom body sides, with the body having a body width defined between the opposing left and right body sides, (4) a solar cell;

b. lamps located about the front body side;

c. at least two clips provided on the body, the clips extending forwardly from the front body side to curve first upwardly and then downwardly and rearwardly over the top body side, wherein a locking hole is defined within the curve of each clip forwardly from the front body side.

12. The clip-on light of claim 11 wherein:

a. the solar cell is situated adjacent the top body side, and b. the body further includes ports situated on the bottom body side through which ultrasound is emitted from the interior of the body.

13. The clip-on light of claim 11 wherein the solar cell is situated adjacent the top body side, with a space being defined between the top body side and at least a portion of the solar cell, whereby a cap brim may be fit between the solar cell and the top body side.

14. A clip-on light comprising:

a. a body having:

(1) a front body side and an opposing rear body side, with the body having a body depth defined between the opposing front and rear body sides, (2) opposing top and bottom body sides extending between the front and rear body sides, with the body having a body thickness defined between the opposing top and bottom body sides, (3) opposing left and right body sides extending between the front and rear body sides and also between the top and bottom body sides, with the body having a body width defined between the opposing left and right body sides, wherein the body is substantially thin, with:

A. a body thickness substantially smaller than the body width and body depth, and B. top and bottom body sides substantially larger than the front and rear body sides and the top and bottom body sides;

b. lamps located about the front body side;

on the body;

c. two or more clips extending from the body, each having a length extending adjacent to the body, whereby an object may be situated between each clip and the body to engage the body to the object; and d. at least one of:

(1) an ultrasound generator emitting ultrasound from one of the body sides other than any body side from which the clips extend, and (2) a solar cell extending adjacent the body, with a space being defined between the body and at least a portion of the solar cell, whereby a cap brim may be fit between the solar cell and the body.

15. The clip-on light of claim 14 wherein each clip extends forwardly from the front body side to then curve outwardly and rearwardly adjacent to one of the top body side and bottom body side, wherein a locking hole is defined within the curve of each clip forwardly from the front body side, whereby a cap brim may be fit between the clip and one of the top body side and bottom body side, with the edge of the cap brim fit within the locking hole.

16. A clip-on light comprising:

a. a body including:

(1) a front body side and an opposing rear body side, with the body having a body depth defined between the opposing front and rear body sides, (2) opposing top and bottom body sides extending between the front and rear body sides, with the body having a body thickness defined between the opposing top and bottom body sides, (3) opposing left and right body sides extending between the front and rear body sides and also between the top and bottom body sides, with the body having a body width defined between the opposing left and right body sides, b. lamps located about the front body side;

c. clips extending adjacent to the top body side, whereby an object may be situated between the clips and the top body side to engage the body to the object; and d. an ultrasound generator emitting ultrasound from one of the body sides other than the top body side.

17. The clip-on light of claim 16 wherein each clip extends forwardly from the front body side to then curve outwardly and rearwardly adjacent to the top body side, wherein a locking hole is defined within the curve of each clip forwardly from the front body side, whereby a cap brim may be fit between the clip and the top body side with the edge of the cap brim fit within the locking hole.

18. The clip-on light of claim 16 further comprising a switch on the body, wherein the switch is actuatable to activate both the lamps and the ultrasound generator.

19. The clip-on light of claim 16 wherein the body further includes a solar cell situated thereon adjacent the top body side.

20. The clip-on light of claim 4 wherein the space between each clip and the top body side decreases as each clip extends rearwardly from the locking hole.

21. The clip-on light of claim 20 wherein the space between each clip and the top body side, after decreasing as each clip extends rearwardly from the locking hole, then increases as each clip extends further rearwardly from the locking hole.

22. The clip-on light of claim 7 wherein the space between each clip and the top body side decreases as each clip extends rearwardly from the locking hole.

23. The clip-on light of claim 22 wherein the space between each clip and the top body side, after decreasing as each clip extends rearwardly from the locking hole, then increases as each clip extends further rearwardly from the locking hole.

24. The clip-on light of claim 11 wherein the space between each clip and the top body side decreases as each clip extends rearwardly from the locking hole.

25. The clip-on light of claim 11 wherein the space between each clip and the top body side, after decreasing as each clip extends rearwardly from the locking hole, then increases as each clip extends further rearwardly from the locking hole.

* * * * *